United States Patent [19]

Miller

[11] Patent Number: 4,489,934

[45] Date of Patent: Dec. 25, 1984

[54] JUMPING ROPE

[76] Inventor: Robert A. Miller, 19330 Sagebrush Trail, Desert Hot Springs, Calif. 92240

[21] Appl. No.: 148,244

[22] Filed: May 9, 1980

[51] Int. Cl.[3] ..... A63B 5/20

[52] U.S. Cl. ..... 472/75

[58] Field of Search ..... 272/74, 75, 68, 122, 272/123, 124, DIG. 5; 273/81.2, 67 R, 73 J; D21/216, 222, 191; 16/115, 114 R, 114 B, 110; 46/77, 1 G; 235/95 B, 96

[56] References Cited

U.S. PATENT DOCUMENTS

| | | | |
|---|---|---|---|
| D. 73,755 | 11/1927 | Mordt | D21/191 X |
| 932,331 | 8/1909 | Russell et al. | 272/75 X |
| 1,189,307 | 7/1916 | Stokes et al. | 272/75 |
| 1,505,473 | 8/1924 | Klubnick | 272/74 |
| 1,714,391 | 5/1929 | McWhirter | 272/123 |
| 2,947,108 | 8/1960 | Dodd, Jr. et al. | 46/77 |
| 3,380,738 | 4/1968 | Papp | 273/26 E |
| 3,421,253 | 1/1969 | Thurston | 46/77 X |
| 3,762,704 | 10/1973 | Gingras | 272/75 |
| 4,179,119 | 12/1979 | Wolf | 272/75 |

FOREIGN PATENT DOCUMENTS

| | | | |
|---|---|---|---|
| 538265 | 3/1957 | Canada | 272/75 |
| 2030998 | 12/1971 | Fed. Rep. of Germany | 273/73 J |
| 2141374 | 2/1973 | Fed. Rep. of Germany | 272/75 |
| 1106485 | 7/1955 | France | 272/75 |
| 498972 | 11/1954 | Italy | 272/75 |
| 354011 | 6/1961 | Switzerland | 272/75 |
| 15615 | of 1889 | United Kingdom | 272/68 |
| 622320 | 4/1949 | United Kingdom | 272/124 |
| 1217867 | 12/1970 | United Kingdom | 272/75 |

*Primary Examiner*—Robert A. Hafer
*Assistant Examiner*—Arnold W. Kramer
*Attorney, Agent, or Firm*—Michael A. Painter

[57] ABSTRACT

A jumping rope for exercising including extendible handles for adjustably altering the moment of force imposed by the swinging rope. The jump rope construction includes evenly extended handles at each end thereof, the extendible handles comprised of a series of sections which can shorten or lengthen the distance between the user's hands and a ball bearing assembly within which the rope is secured. The rope is joined to the first handle section by a ball bearing assembly which is recessed from the handle shoulder. The first section is a terminal coupling and has a tapered cross-section at the shoulder thereof to reduce the friction between the rope and the shoulder of the handle section. The opposite end of the receiving handle section is joined to a mating extension which can be easily gripped by the user. The extended member can be coupled to an additional extension section to lengthen the handle and thereby extend the distance between the user's hand and the point at which the force of the swinging rope will be applied to the handle.

4 Claims, 3 Drawing Figures

JUMPING ROPE

BACKGROUND OF THE INVENTION

1. Field of the Invention

The present invention relates generally to jump ropes and more specifically to a jump rope construction which has an extendible handle to permit a change in the force which is applied to the user's hands, arms and shoulders by the swinging rope.

2. Prior Art

The structure of exercise devices which are in the form of jump ropes has improved over the years from its beginning models, which featured a simple rope. More sophisticated structures were then provided wherein a simple handle was tied or otherwise crudely attached to each end of the rope. More recently, the structure has been improved wherein large wooden handles were staked by a metal plate, which defined a central opening through which a rope was held by a ball bearing assembly which fit within the wooden handle. One of the inherent problems in this type of design was the tendency of the rope to twist because of its connection between the rope and handle.

The simplified design was later improved to utilize a ball bearing assembly, but such assemblies were too expensive and sophisticated for the intended use. Its disassembly for repair or replacement purposes was impossible due to the particular connections used between the rope and handle. A subsequent improvement upon the devices taught in the prior art uses only a ball bearing assembly which defines at its center a rope opening through which the rope extends and is held by the stopping element. The ball bearing assembly includes the usual race and balls rotatably encased within a ball bearing housing.

One of the basic problems inherent in all of the devices taught by the prior art is the placement of the connection between the rope and the handle irrespective of whether a ball bearing assembly is used. Since the portion of the rope which extends from the handle must curve about the end of the handle in order to be placed in its proper position, any crimping or friction which is created between the rope ending and the handle will retard its proper use. In addition, the devices taught by the prior art fail to provide for means which would extend the distance between the portion of the handle which is held by the user and the interface between the handle and the rope. By providing for an extension of this distance, the force imposed by the moving rope on the hands, arms and shoulders of the user can be increased or decreased at will thereby enabling the user to adjust the ease or difficulty of the exercise.

The present invention substantially resolves those problems inherent in the devices taught by the prior art. The present invention jump rope construction employs a handle which can be elongated or decreased in length. The change in the length of the handle will change the force imposed on the user's hands when the rope is in use. In addition, the placement of the connection between the rope and handle as well as the profile of the terminal coupling of the handle improves the ease with which the present invention can be used as well as increasing the efficiency of the total assembly.

SUMMARY OF THE INVENTION

The present invention comprises a jump rope construction which includes adjustable extensions of the handles thereof as well as an improved ball bearing assembly for coupling the rope to the rope handles. The handles for the present invention jump rope comprise a series of interconnected couplings and extensions to effectively extend or reduce the distance between the hands of the user and the point of contact between the rope and handle. The ball bearing assembly to which the rope is coupled is recessed within the handle. The terminal coupling of the handle is tapered outwardly to avoid and/or reduce any friction between the rotating rope and the handle. The handle coupling is adapted to engage a handle extension which at the opposite end thereof can receive an additional coupling. The distance between the user's hands and the bearing assembly effectively increases the moment arm which transfers the force created by the rotating rope and the user's hands, arms and shoulders.

It is therefore an object of the present invention to provide an improved jump rope construction.

It is another object of the present invention to provide a jump rope construction having handles of adjustable length.

It is still another object of the present invention to provide a jump rope construction which reduces interference with the rotation of the rope.

It is still yet another object of the present invention to provide a jump rope construction which is simple and inexpensive to fabricate.

The novel features which are believed to be characteristic of the invention, both as to its organization and method of operation, together with further objectives and advantages thereof, will be better understood from the following description considered in connection with the acompanying drawing in which a presently preferred embodiment of the invention is illustrated by way of example. It is to be expressly understood, however, that the drawing is for the purpose of illustration and description only and is not intended as a definition of the limits of the invention.

DESCRIPTION OF THE PRESENTLY PREFERRED EMBODIMENT

Figure 1:
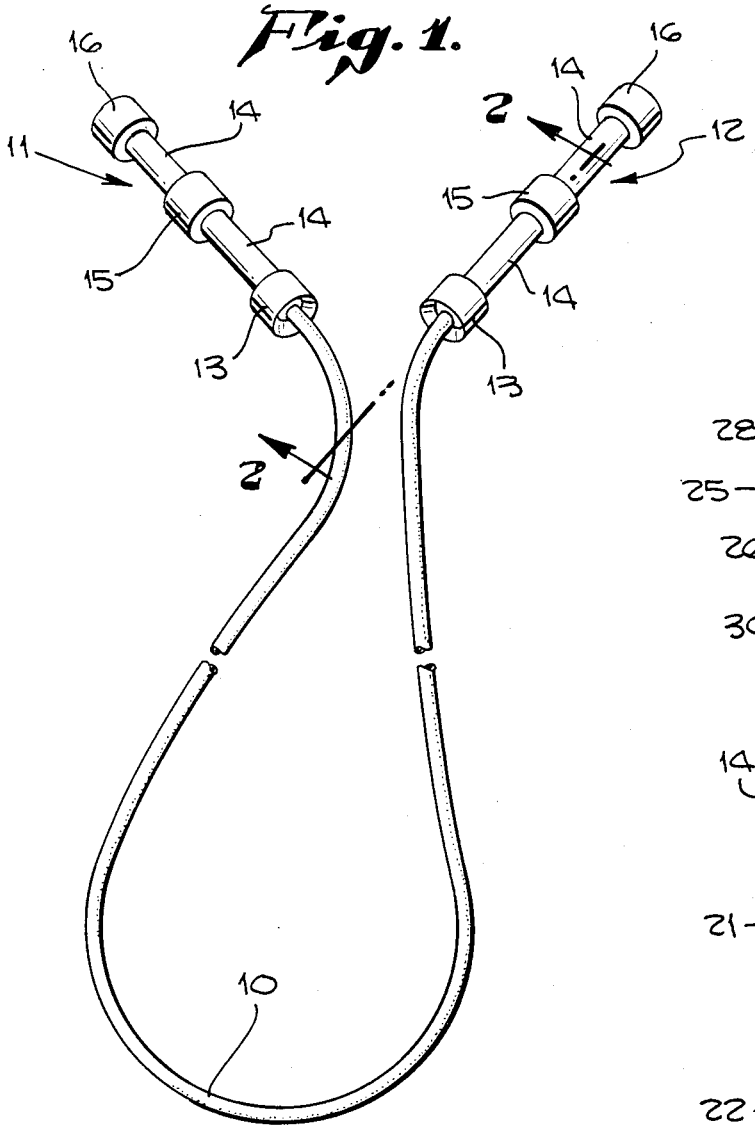
FIG. 1 is a pictorial view of a jump rope according to the present invention showing a rope extended between two handles.

An understanding of the present invention can be best gained by reference to FIG. 1 wherein a rope 10 is shown extending between handles 11 and 12. The use of the present invention is conventional in that the user holds each of the handles 11 and 12 in one hand respectively, rotating rope 10 while preferably maintaining handles 11 and 12 in parallel spaced relationship to the ground. As will be described hereinbelow, each of the handles 11 and 12 employs a terminal coupling 13 which is engaged to an extension member 14. In a like manner, extension member 14 is engaged to intermediate coupling 15 which can, if desired, be engaged to an additional extension member 14. Since an object of the present invention is to provide handles 11 and 12 which can be adjustably extended to any length chosen by the user, the final extension member 14 is closed by an appropriate cap 16 which will facilitate the user to maintain his hands in a fixed position when the rope 10 rotates.

Figure 2:
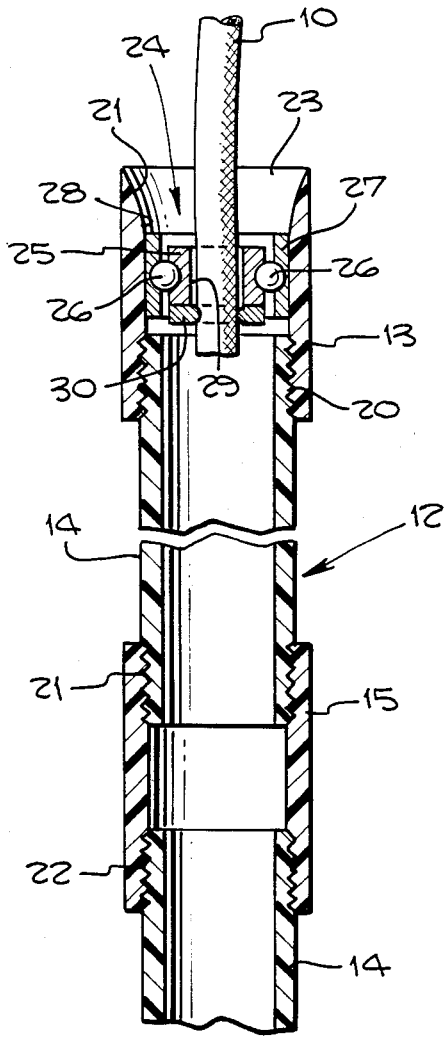
FIG. 2 is a cross-sectional view taken through line 2—2 of FIG. 1 and particularly showing the connection between the adjustably extended handle and rope through the use of a ball bearing assembly.

An understanding of the operation of the present invention can be best gained by reference to FIG. 2 wherein a cross-sectional view of the interface between the rope and handle is shown. As stated, handle 12 (and 11) comprises terminal coupling 13 which is serially engaged to extension member 14, intermediate coupling 15 and, if desired, further extension member 14. A preferred way of providing an adjustable construction for handle 12 is shown in FIG. 2. The end of terminal coupling 13 opposite rope 10 employs interfaced screw-threads 20 along a portion of the inner diameter of terminal coupling 13 and the outer diameter of extension member 14. Extension member 14 is appropriately threaded to engage interface threads 20. The interface 21 between intermediate coupling 15 and extension member 14 employs similar mating screw-threads disposed along the inner diameter of intermediate coupling 15 and the outer diameter of extension member 14 respectively. Finally, intermediate coupling 15 is engaged with a second extension member 14 at interface 22 which comprises screw-threads disposed along the inner diameter of intermediate coupling 15 and the outer diameter of extension member 14.

Recessed within open end 23 of terminal coupling 13 is a ball bearing assembly generally designated by the reference numeral 24. Ball bearing assembly 26 typically includes an inner race element 25 and ball bearings 26 which are known in the prior art. Ball bearing housing 27 forms the outer race and defines an outer surface of generally circular cross-section which is secure to the cylindrical inner wall 28 of terminal coupling 13. Rope 10 extends through a central opening 29 through inner race element 25. The rope is secured to ball bearing assembly 24 by conventional means such as a washer stop element 30 which is in end abuttment with inner race element 25.

Figure 3:
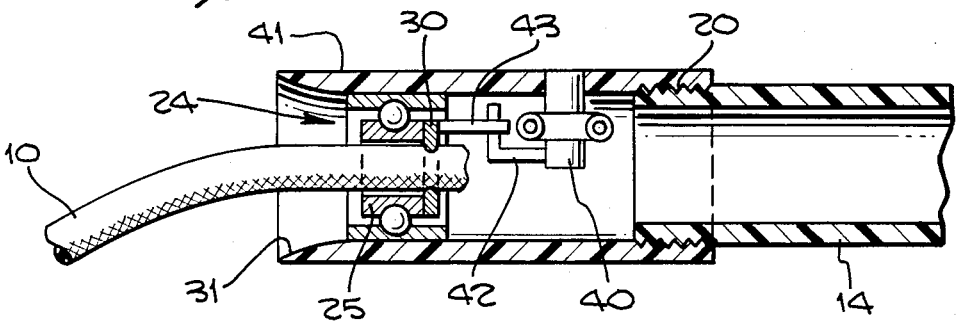
FIG. 3 is a cross-sectional view of another form of the present invention employing a counter to indicate the number of rotations of the rope.

An objective of the present invention is to reduce any frictional forces which may exist between rope 10 and terminal coupling 13 while the present invention is being used. In order to accomplish this objective, the inner wall 28 of terminal coupling 13 at the open end 23 is tapered outwardly to provide a surface 31 which is tapered outwardly to provide a constantly increasing diameter. As is shown in FIG. 3, the contact between rope 10 and surface 31 is reduced by the constantly increasing diameter of surface 31, the objective thereof being to match the curvature of surface 31 of terminal coupling 13 to the curvature of rope 10 as it exits from open end 23 of terminal coupling 13. It is also to be noted that recessing ball bearing assembly 24 within the open end 23 of terminal coupling 13 aids the rotation of rope 10 with relationship to handles 11 and 12.

Another form of the present invention is shown in FIG. 3. FIG. 3 illustrates the addition of a rotation counter 40 to the previously described assembly. A terminal coupling 41 is utilized, the interior surface employing a surface 31 in the same manner as that described with respect to FIG. 2. Counter 40 is a conventional device which is secured within the inner opening of terminal coupling 41, the readout of counter 40 being visible through the wall of terminal coupling 41. Counter 40 employs stepping lever 42 which will increment the count each time it is engaged by rod 43 which is secured to washer stop elements 30 perpendicular to the face thereof. As can be seen in FIG. 3, each time rope 10 is rotated, inner race element 25 of ball bearing assembly 24 will rotate accordingly. Since washer stop element 30 is secured to inner race element 25, rod 43 will rotate in a like manner. As a result of rod 43 contacting stepping lever 42 once per rotation, counter 40 will increment the rotation count properly.

The present invention provides an improved jump rope construction which facilitates the rotation of rope 10. One of the most essential features of the present invention is provided by the addition of extension members 14 and the mating intermediate coupling 15. By the addition of several extension members 14, the distance between the ball bearing assembly 24 and the user's hands is achieved. When the rope 10 is rotated, the force imposed on the user's hands, arms and shoulders will be increased in relation to the distance between his hands and the ball bearing assembly 24. As this distance is increased, the value of the exercise is increased accordingly. It is therefore clear that the present invention provides an improved construction for a jump rope in a manner which is not disclosed by the prior art.

I claim:

1. A jump rope construction comprising:

(a) a terminal coupling comprising a cylindrical, hollow member having a first and second end, the inner surface of the first end of said terminal coupling being tapered outwardly to form a constantly increasing diameter at the first end thereof;

(b) a plurality of extension members joined by intermediate couplings, said extension members being axially joined to the second end of said terminal coupling whereby the distance between the terminal coupling and the opposite extension member is adjustably increased; and (c) a ball bearing assembly secured within the hollow interior of the terminal coupling substantially adjacent the first end of said terminal coupling, the ball bearing assembly including ball bearings, a race and a ball bearing housing secured to the interior surface of said terminal coupling, said ball bearing assembly defining an opening at its center for attachment of the rope therethrough.

2. A jump rope construction as defined in claim 1 including a revolution counter coupled within the hollow interior of said terminal coupling, said revolution counter including a stepping lever, and a rod secured to said ball bearing assembly parallel to the central axis of the terminal coupling and adapted to engage said stepping lever once per revolution of said ball bearing assembly.

3. A jump rope construction comprising:

(a) handle assembly comprising a cylindrical hollow member having a central axis therethrough, said handle assembly having first and second ends, the rope extending from said first end, the inner surface of the first end of said handle assembly being tapered outwardly to form constantly increasing diameter at said first end;

(b) a ball bearing assembly secured within the hollow interior of said handle assembly and recessed at the first end of said handle assembly, said ball bearing assembly including ball bearings, a race and a ball bearing housing secured to the inner surface of said handle assembly, said ball bearing assembly defining an opening at the center thereof along said central axis for attachment to the rope; and (c) a series of extension members and intermediate couplings removeably secured to the second end of said handle assembly whereby the distance between the handle assembly and the opposite extension member is adjustable.

4. A jump rope construction as defined in claim 3 including a revolution counter coupled to said handle assembly within the hollow interior thereof, said revolution counter including a stepping lever and a rod secured to said ball bearing assembly parallel to the central axis of said handle assembly and adapted to engage the stepping lever of said revolution counter once per revolution of said ball bearing assembly.

* * * * *